US007375468B2

(12) United States Patent
Ko

(10) Patent No.: US 7,375,468 B2
(45) Date of Patent: May 20, 2008

(54) PLASMA DISPLAY PANEL HAVING SCAN ELECTRODE CLOSER TO ADDRESS ELECTRODE

(75) Inventor: Ji-Sung Ko, Cheonan-si (KR)

(73) Assignee: Samsung SDI Co., Ltd., Suwon (KR)

( * ) Notice: Subject to any disclaimer, the term of this patent is extended or adjusted under 35 U.S.C. 154(b) by 498 days.

(21) Appl. No.: 10/994,263

(22) Filed: Nov. 23, 2004

(65) Prior Publication Data

US 2005/0116896 A1 Jun. 2, 2005

(30) Foreign Application Priority Data

Nov. 29, 2003 (KR) ..... 10-2003-0086055

(51) Int. Cl.
*H01J 17/49* (2006.01)

(52) U.S. Cl. ..... 313/585; 313/584; 313/586

(58) Field of Classification Search ..... 313/582–587
See application file for complete search history.

(56) References Cited

U.S. PATENT DOCUMENTS 6,734,627 B2 * 5/2004 Ahn ..... 313/587
2003/0155862 A1 * 8/2003 Shirozu ..... 313/582
2003/0209982 A1 * 11/2003 Kim et al. ..... 313/584

FOREIGN PATENT DOCUMENTS

| | | |
|---|---|---|
| JP | 2002-203484 | 7/2002 |
| JP | 2002-216639 | 8/2002 |
| JP | 2002319350 | * 10/2002 |

* cited by examiner

*Primary Examiner*—Joseph L. Williams
*Assistant Examiner*—Bumsuk Won
(74) *Attorney, Agent, or Firm*—H.C. Park & Associates, PLC

(57) ABSTRACT

A plasma display panel comprising a first panel having a plurality of discharge sustaining electrode pairs, and a second panel having a plurality of address electrodes and facing the first panel. A discharge sustaining electrode pair includes a scan electrode and a sustain electrode having discharge surfaces facing each other, and the scan electrode is closer to the address electrode than the sustain electrode. The plasma display panel requires a reduced address voltage and discharge voltage.

10 Claims, 7 Drawing Sheets

PLASMA DISPLAY PANEL HAVING SCAN ELECTRODE CLOSER TO ADDRESS ELECTRODE

CROSS REFERENCE TO RELATED APPLICATION

This application claims priority to and the benefit of Korean Patent Application No. 10-2003-0086055, filed on Nov. 29, 2003, which is hereby incorporated by reference for all purposes as if fully set forth herein.

BACKGROUND OF THE INVENTION

1. Field of the Invention

The present invention relates to a plasma display panel (PDP), and more particularly, to a PDP having improved driving efficiency and brightness.

2. Discussion of the Background

Generally, a PDP displays images by using a discharge effect. It is thin and may have a large screen, as well as high display capacity, high brightness, high contrast, clear latent imagery, and large viewing angle. Therefore, PDPs are considered to be a next generation display device for replacing the cathode ray tube (CRT).

The PDP may be categorized as a direct current (DC) type PDP and an alternating current (AC) type PDP according to its driving voltage waveforms and discharge cell structure. In the DC PDP, charged electrons move directly between corresponding electrodes since the electrodes are exposed in the discharge space. However, in the AC PDP, a dielectric layer covers at least one electrode, and discharge occurs due to an electric field of a wall charge instead of a direct movement of charges between electrodes.

Most PDPs being produced at this time are AC PDPs, and FIG. 1 shows a typical structure for a surface discharge AC PDP. FIG. 2 shows a discharge cell of the PDP of FIG. 1.

Referring to FIG. 1 and FIG. 2, a PDP comprises a first panel 110 and a second panel 120 facing the first panel 110.

The first panel 110 comprises a plurality of stripe shaped sustain electrodes $X_1, \ldots, X_n$ and scan electrodes $Y_1, \ldots, Y_n$ on a first substrate 111. A first dielectric layer 114 covers the sustain electrodes $X_1 \ldots X_n$ and scan electrodes $Y_1 \ldots Y_n$, and a protective layer 115 covers the first dielectric layer 114. As shown in FIG. 2, the sustain and scan electrodes may comprise transparent electrodes $X_{na}$ and $Y_{na}$, which may be formed of a transparent conductive material such as an indium tin oxide (ITO), and bus electrodes $X_{nb}$ and $Y_{nb}$, which may be formed of highly conductive material, respectively.

The second panel 120 comprises stripe shaped address electrodes $A_{R1}, \ldots, A_{Bm}$ formed on a second substrate 121 and substantially orthogonal to the sustain electrodes $X_1, \ldots, X_n$ and the scan electrodes $Y_1, \ldots, Y_n$. A second dielectric layer 123 covers the address electrodes $A_{R1} \ldots A_{BM}$, and barrier ribs 124, which define a plurality of discharge cells, are formed on the second dielectric layer 123. Fluorescent layers 125 are formed on the second dielectric layer 123 and the sides of the barrier ribs 124. The fluorescent layers 125 comprise red, green, and blue fluorescent layers.

A discharge gas is filled in a discharge space formed by joining the first and second panels 110 and 120 together.

FIG. 3 is a timing diagram showing typical driving signals for the PDP of FIG. 1. In FIG. 3, reference numerals $S_{AR1}, \ldots, S_{ABm}$ represent driving signals applied to the address electrodes $A_{R1}, \ldots, A_{Bm}$, reference numerals $S_{X1}, \ldots, S_{Xn}$ represent driving signals applied to the sustain electrodes $X_1, \ldots, X_n$, and reference numerals $S_{Y1}, \ldots S_{Yn}$ represent driving signals applied to the scan electrodes $Y_1, \ldots, Y_n$.

A basic method for driving a PDP may include sequentially performing reset, address, and sustain periods. The reset period (not shown) provides uniform charge states for all discharge cells.

In the address period A, wall charges are generated in selected discharge cells. Referring to FIG. 3, display data signals are applied to the address electrodes $A_{R1}, \ldots, A_{Bm}$ while sequentially applying scan pulses of a ground voltage $V_G$ to the scan electrodes $Y_1, \ldots, Y_n$, which are biased to $V_{scan}$. When applying the display data signals to the address electrodes $A_{R1}, \ldots, A_{Bm}$, a positive address voltage $V_A$ selects the discharge cells, and the ground voltage $V_G$ is applied when a discharge cell is not to be selected. Accordingly, applying the display data signal of the voltage $V_A$ forms wall charges in the corresponding discharge cells, and wall charges are not formed in the corresponding discharge cells when applying the ground voltage $V_G$.

In the sustain period S, sustain discharge occurs in selected discharge cells by alternately applying a voltage $V_S$ to the sustain electrodes $X_1, \ldots, X_n$ and the scan electrodes $Y_1, \ldots, Y_n$. The discharge occurs when applying a voltage to the cells that exceeds their discharge firing voltage. The voltage applied to the cell includes the voltage $V_S$ and its wall voltage.

Referring to FIG. 2, a sustain discharge generates plasma, and ultra violet rays emitted by the plasma excite the fluorescent layers 125 to emit visible light.

Sustain discharges generate meta-stable particles of atoms and molecules. These meta-stable particles ionize neutron particles by colliding with them since the meta-stable particles have a relatively long lifetime, which may decrease the discharge-sustain and discharge firing voltages.

As shown in FIG. 2, the surface discharge type PDP may have a semicircular sustain discharge path. The meta-stable particles generated in these discharge paths may collide with the barrier ribs 124, shown in FIG. 1, and the fluorescent layers 125. Therefore, the meta-stable particles near the barrier ribs 124 and the fluorescent layers 125 may have a relatively short lifetime, which may increase the discharge-sustain and discharge firing voltages.

To solve this problem, Korean Patent Application No. 2002-0072590 discloses a method that generates a linear discharge route formed by disposing the sustain electrode and the scan electrode to face each other.

However, this method may require a high address voltage to induce address discharge, thereby reducing driving efficiency.

SUMMARY OF THE INVENTION

The present invention provides a PDP having an improved structure that may increase driving efficiency by reducing an address voltage.

The present invention also provides a PDP that may reduce a discharge sustaining voltage.

The present invention also provides a PDP having improved brightness and image definition since a sufficient amount of meta-stable particles that allow for a decreased driving voltage may be attained even with fine discharge cells.

Additional features of the invention will be set forth in the description which follows, and in part will be apparent from the description, or may be learned by practice of the invention.

The present invention discloses a PDP including a first panel having a plurality of discharge sustaining electrode pairs and a second panel having a plurality of address electrodes and facing the first panel. A discharge sustaining electrode pair comprises a scan electrode and a sustain electrode, and a discharge surface of the scan electrode and a discharge surface of the sustain electrode face each other. A distance between the scan electrode and an address electrode is less than a distance between the sustain electrode and the address electrode.

The present invention also discloses a PDP including a first panel having a plurality of discharge sustaining electrode pairs and a second panel having a plurality of address electrodes and facing the first panel. A discharge sustaining electrode pair comprises a scan electrode and a sustain electrode, and a discharge surface of the scan electrode and a discharge surface of the sustain electrode face each other. A surface of the scan electrode facing an address electrode is wider than a surface of the sustain electrode facing the address electrode.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE ILLUSTRATED EMBODIMENTS

The present invention will now be described more fully with reference to the accompanying drawings, in which exemplary embodiments of the invention are shown.

Figure 1:
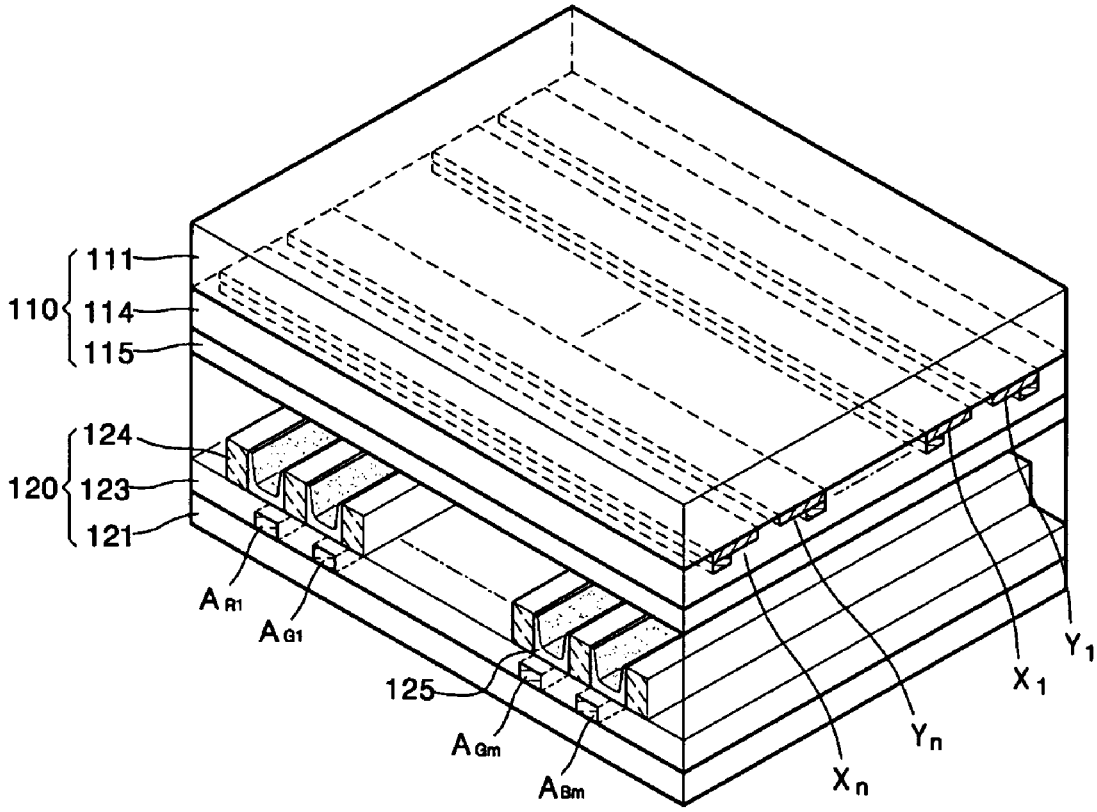
FIG. 1 (PRIOR ART)
FIG. 1 is a perspective view showing a conventional PDP.
Figure 2:
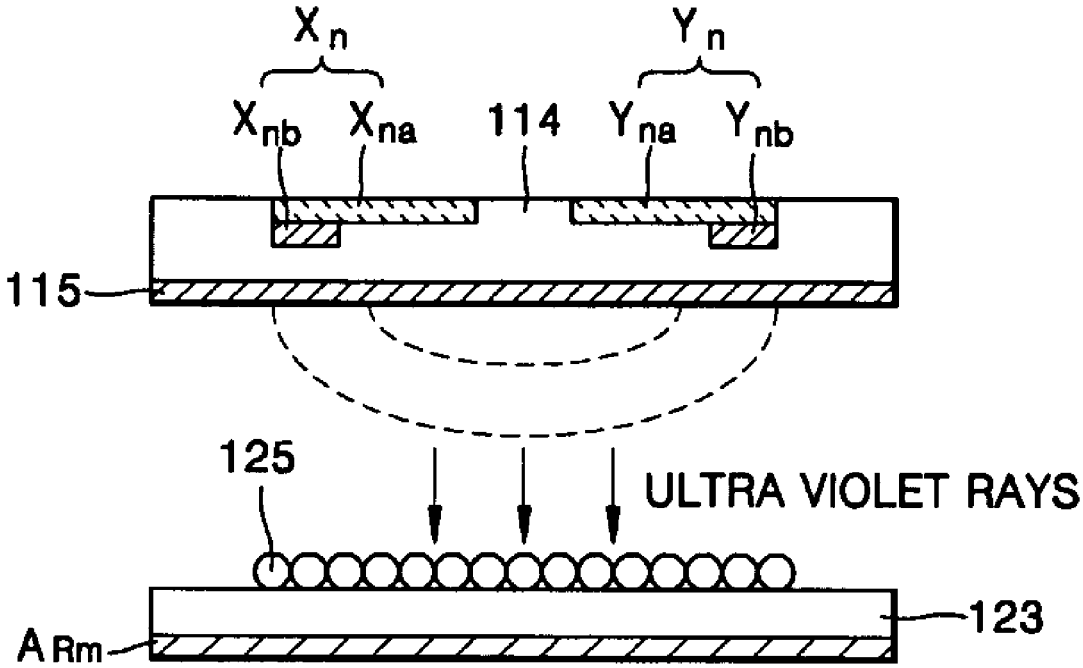
FIG. 2 (PRIOR ART)
FIG. 2 is a cross-sectional view showing a discharge cell of the PDP of FIG. 1.
Figure 3:
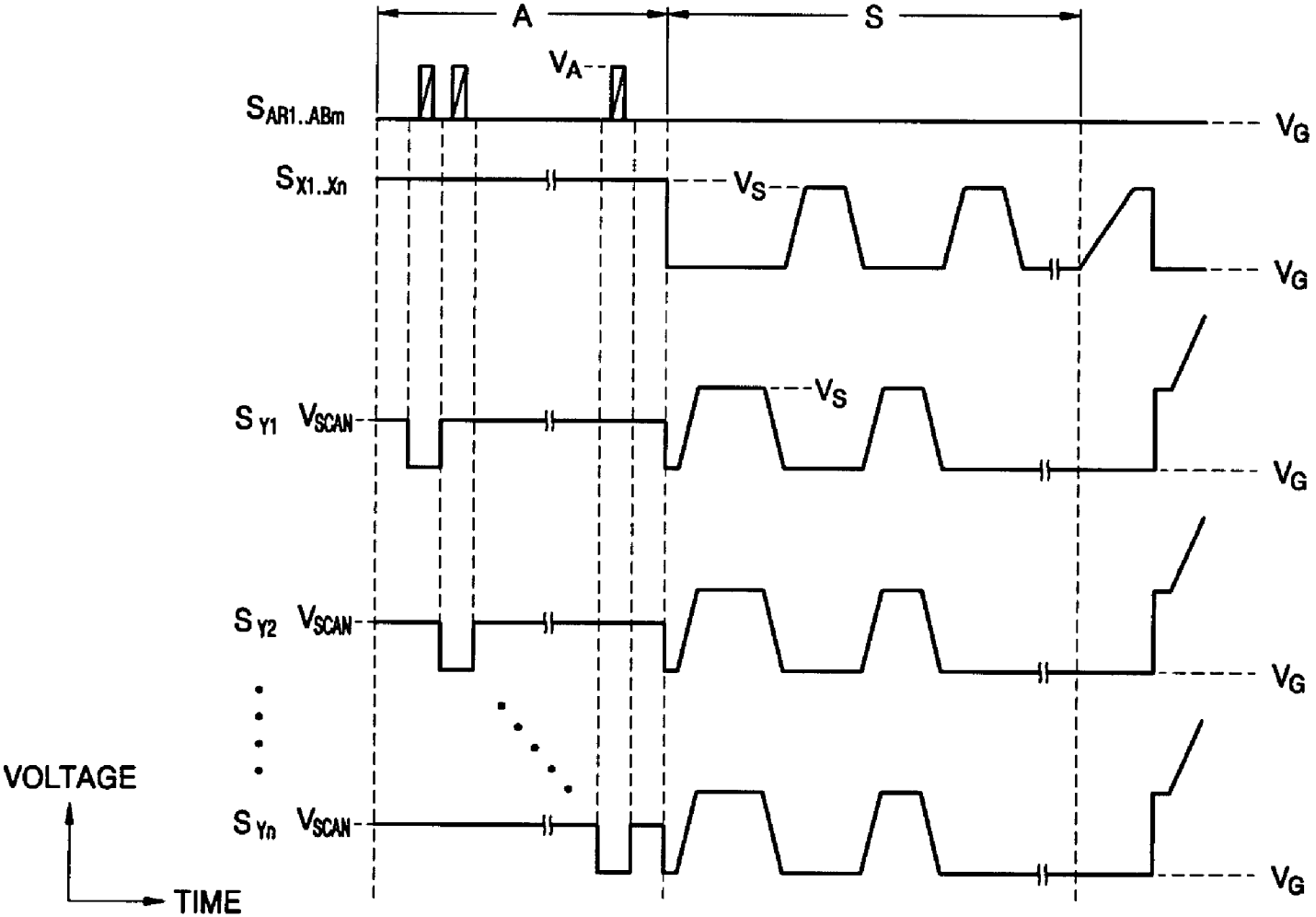
FIG. 3 (PRIOR ART)
FIG. 3 is a timing diagram showing typical driving signals of the PDP of FIG. 1.
Figure 4:
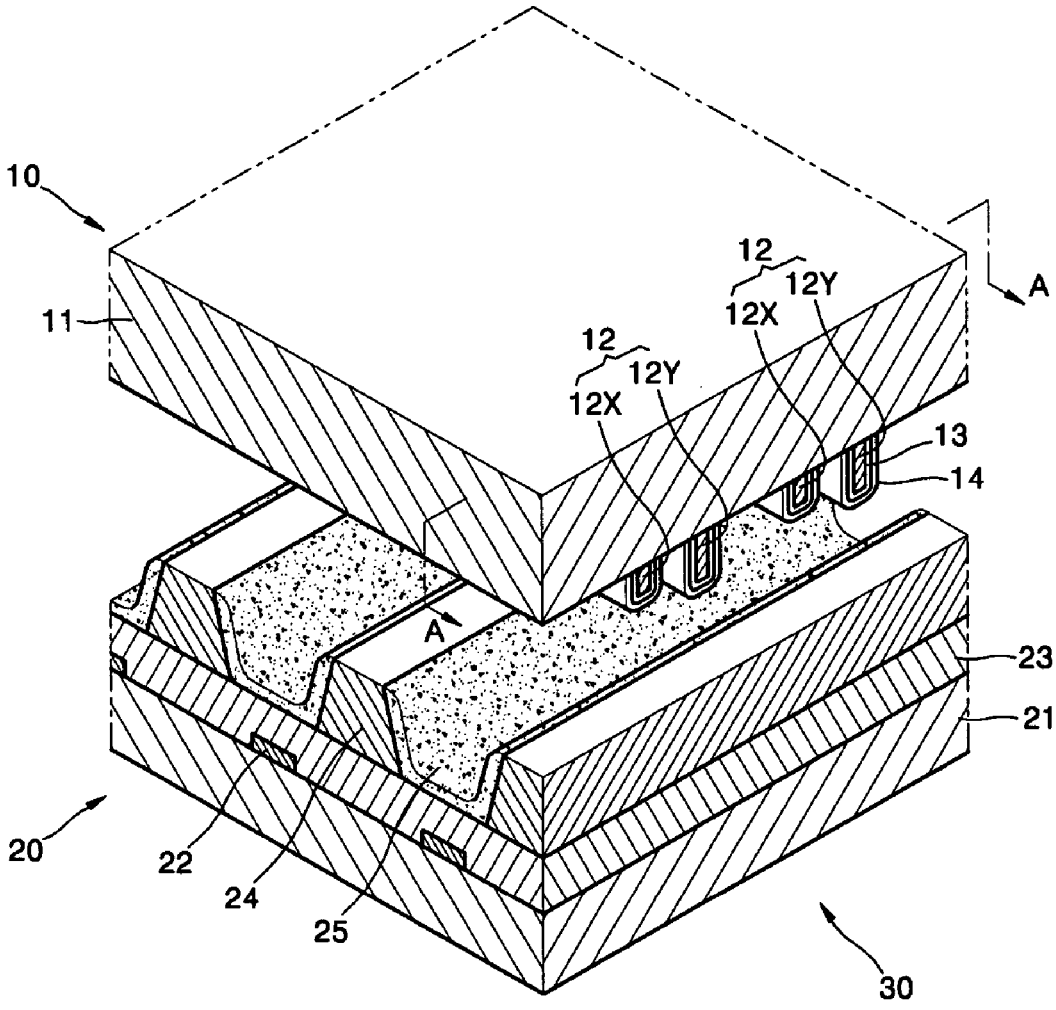
FIG. 4 is a perspective view showing a PDP according to a first exemplary embodiment of the present invention.
Figure 5:
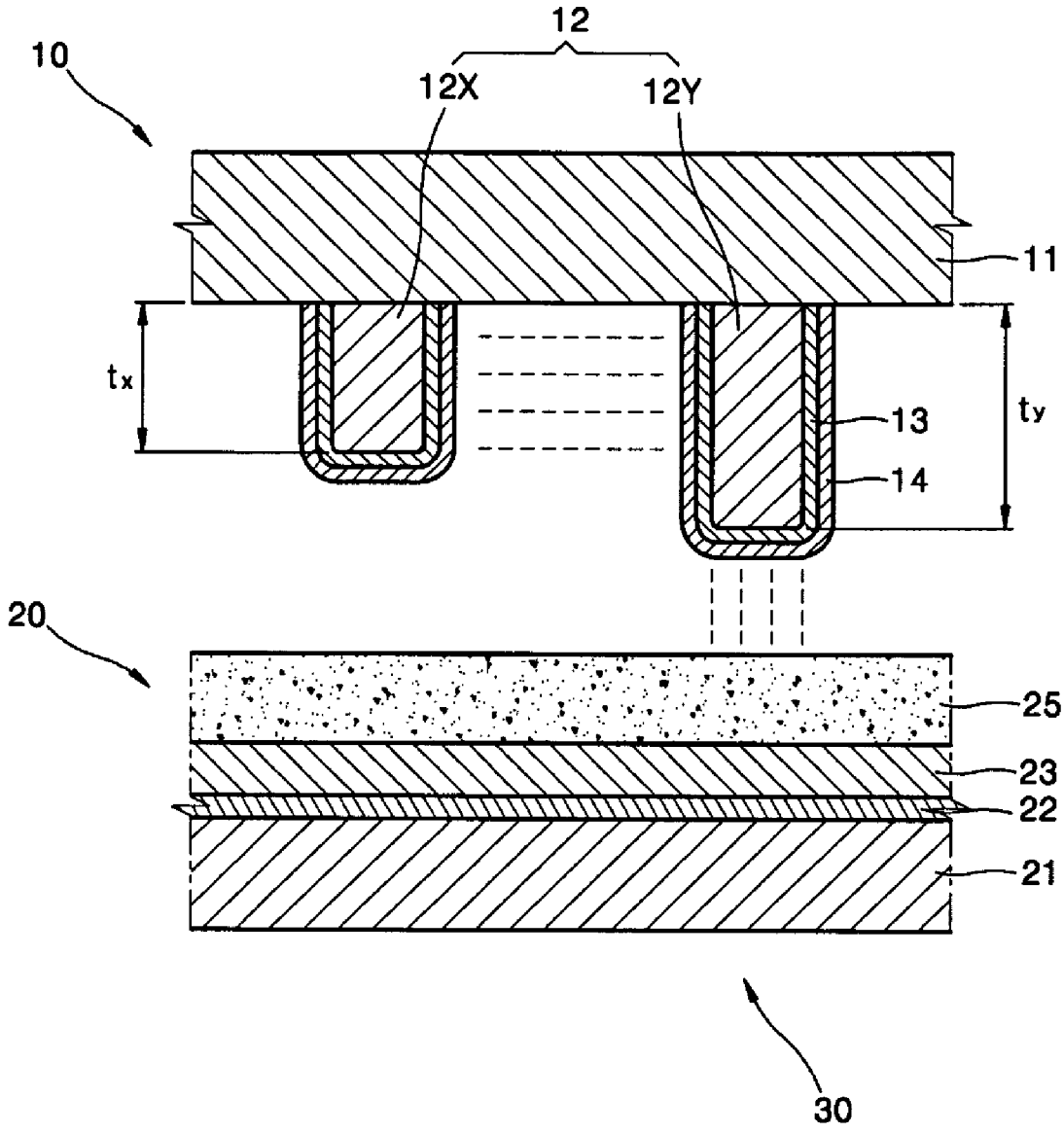
FIG. 5 is a cross-sectional view taken along a line A-A of FIG. 4.

FIG. 4 is a perspective view showing a PDP according to a first exemplary embodiment of the present invention, and FIG. 5 is a cross-sectional view taken along a line A-A of FIG. 4.

Referring to FIG. 4 and FIG. 5, a PDP 30 comprises a first panel 10 and a second panel 20 facing each other.

The first panel 10 comprises a first substrate 11, a discharge sustaining electrode pair 12, a first dielectric layer 13, and a protective layer 14.

The first substrate 11 may be a glass substrate. A plurality of discharge sustaining electrode pairs 12 may be formed on the first substrate 11 in a stripe pattern, and each discharge sustaining electrode pair comprises a sustain electrode $\mathbf{12}_X$ and a scan electrode $\mathbf{12}_Y$ facing each other. As shown in FIG. 5, the sustain electrode $\mathbf{12}_X$ and the scan electrode $\mathbf{12}_Y$ may be formed to sufficient thicknesses $t_x$ and $t_y$, respectively, since their facing surfaces are discharge surfaces. Disposing the sustain electrode $\mathbf{12}_X$ and the scan electrode $\mathbf{12}_Y$ facing each other forms an approximately linear shaped discharge path. Therefore, the sustain discharge voltage may be reduced.

The scan electrode $\mathbf{12}_Y$ is closer to address electrode 22 than the sustain electrode $\mathbf{12}_X$ because a thickness $t_y$ of the scan electrode $\mathbf{12}_Y$ is greater than a thickness $t_x$ of the sustain electrode $\mathbf{12}_X$. In this case, reducing a distance between the address electrode 22 and the scan electrode $\mathbf{12}_Y$ may reduce an address voltage needed for address discharging.

The discharge sustaining electrode pair 12 may be formed of a transparent material, such as ITO, so that it may transmit visible light emitted from a fluorescent layer 25. Also, the discharge sustaining electrode pair 12 may comprise a metal electrode with the transparent electrode to enhance electrical conductivity. The metal electrode may be a single layer formed of a material having high electric conductivity, such as aluminium or silver, or a multiple layer formed of chrome-copper-chrome.

The first dielectric layer 13 may cover the discharge sustaining electrode pair 12, and a protective layer 14, which protects the first dielectric layer 13 from ions or electrons, may be formed on the first dielectric layer 13. More specifically, the first dielectric layer 13 and the protective layer 14 may be formed on the surfaces of the scan electrode $\mathbf{12}_Y$ and the sustain electrode $\mathbf{12}_X$, and a discharge space for discharging in opposite directions is formed between the scan electrode $\mathbf{12}_Y$ and the sustain electrode $\mathbf{12}_X$.

The second substrate 21 may be formed of glass like the first substrate 11, and the address electrodes 22 may be formed in a stripe pattern on the second substrate 21. The address electrodes 22 may be formed substantially orthogonal to the discharge sustaining electrode pairs 12.

The second dielectric layer 23 may cover the address electrodes 22, and a plurality of barrier ribs 24, which define discharge cells, may be formed on the second dielectric layer 23.

As shown in FIG. 4, the side walls of the barrier ribs 24 may be coated with the fluorescent layers 25 comprising red, green, and blue fluorescent layers.

The first panel 10 and the second panel 20 may be bonded and sealed using frit glass. An inner space of the PDP 30 formed by sealing the panels together may be filled with an inert discharge gas, such as He, Ne, Xe, Ar, or Kr. Considering electrode driving voltage and durability, a gas mixture comprising Xe and two or three added components may be used.

As described above, the discharge path between the sustain electrode $\mathbf{12}_X$ and the scan electrode $\mathbf{12}_Y$ may be linearly shaped by disposing the sustain electrode $\mathbf{12}_X$ and the scan electrode $\mathbf{12}_Y$ facing each other. Therefore, the meta-stable particles formed during sustaining discharge may exist between the sustain electrode $\mathbf{12}_X$ and the scan electrode $\mathbf{12}_Y$, which may increase their lifespan by preventing or minimizing collisions with the walls of the fluorescent layers 25 or the barrier ribs 24. Consequently, a discharge firing voltage and a discharge sustain voltage may be reduced, and PDP brightness may be improved. Furthermore, this structure may be advantageous for forming a high definition PDP since a sufficient amount of meta-stable particles may be attained, even if the discharge cells are very fine.

Also, extending the scan electrode $12_Y$ toward the address electrode 22 reduces the gap between them and strengthens an electric field in the gap, thereby reducing the address voltage required for an address discharge. Therefore, the PDP's driving efficiency may be improved, and a miss-addressing, which is an unwanted address discharge between the sustain electrode $12_X$ and the address electrode 22, may be prevented, thereby enabling stable driving of the PDP 30.

Figure 6:
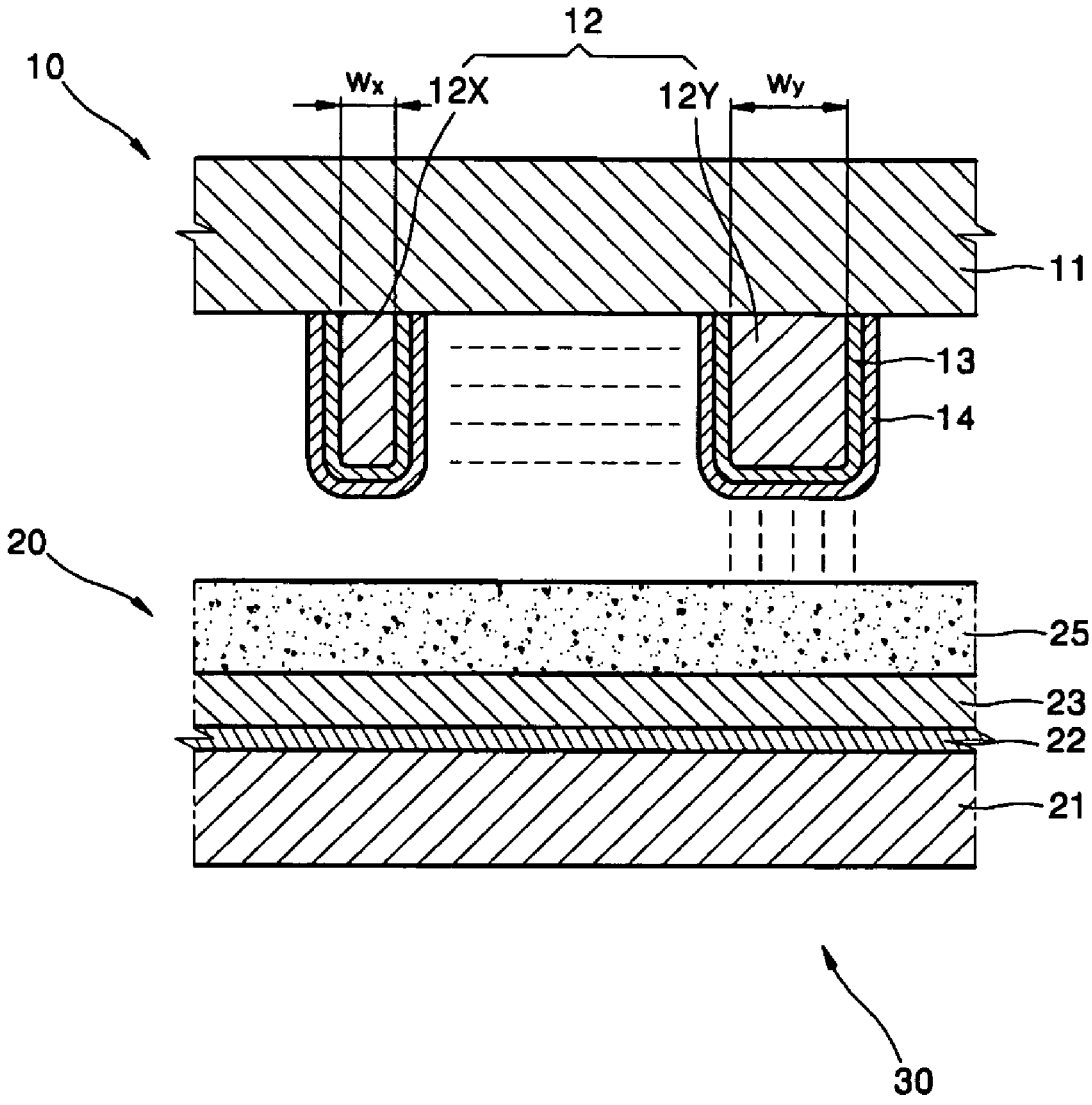
FIG. 6 is a cross-sectional view showing a PDP according to a second exemplary embodiment of the present invention.

FIG. 6 is a cross-sectional view showing a PDP according to a second exemplary embodiment of the present invention.

Referring to FIG. 6, the sustain electrode $12_X$ and the scan electrode $12_Y$ face each other to perform a facing discharge, and unlike the first exemplary embodiment, they may be equally thick. Further, in the second exemplary embodiment, a surface of the scan electrode $12_Y$ facing the address electrode 22 is wider than a surface of the sustain electrode $12_X$ facing the address electrode 22. For example, as shown in FIG. 6, the scan electrode $12_Y$ may be wider than the sustain electrode $12_X$ ($W_Y > W_X$). This configuration may reduce the address voltage required for causing an address discharge between the scan electrode $12_Y$ and the address electrode 22, thereby improving driving efficiency of the panel 30.

Figure 7:
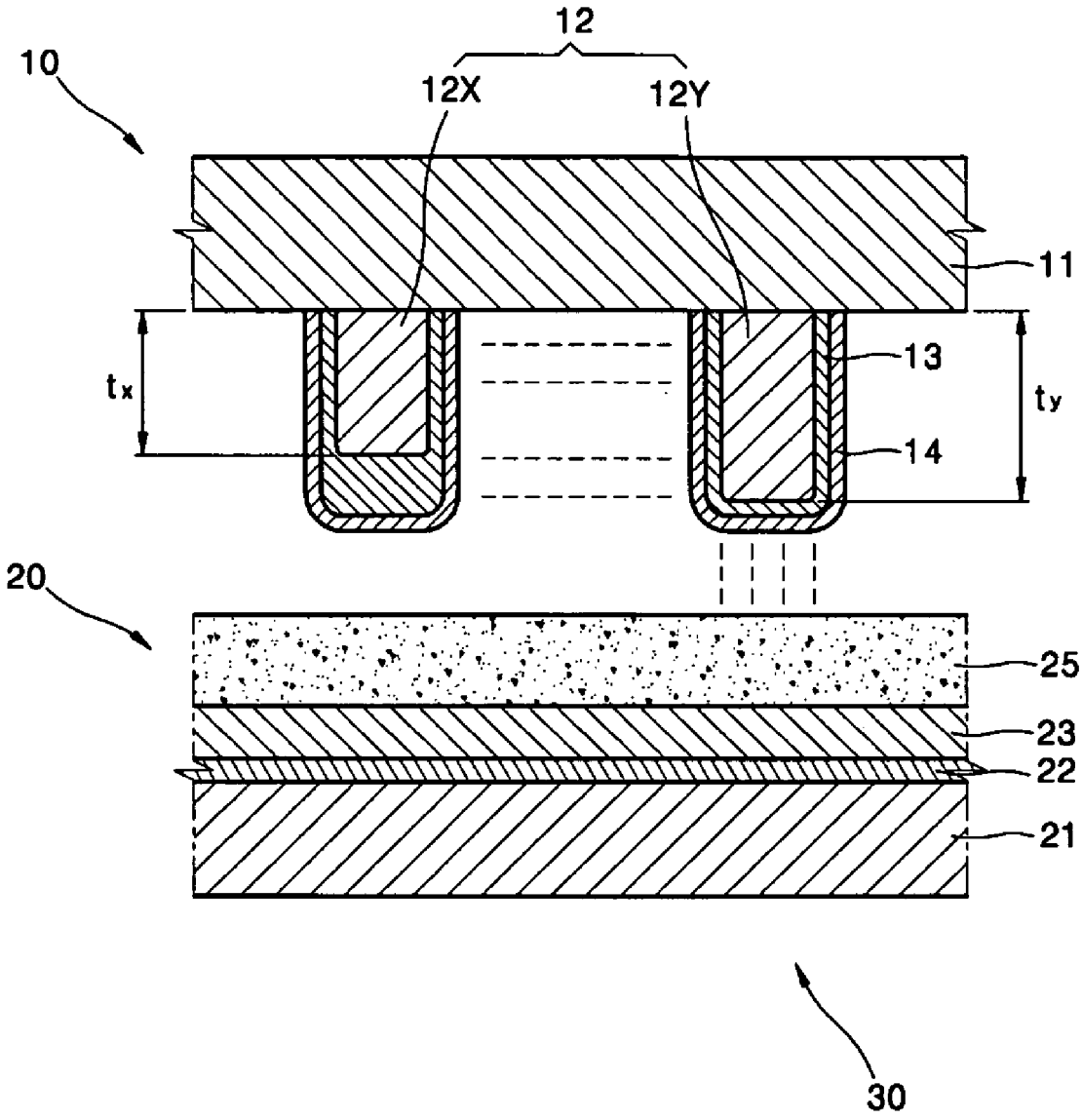
FIG. 7 is a cross-sectional view showing a PDP according to a third exemplary embodiment of the present invention.

FIG. 7 is a cross-sectional view showing a PDP according to a third exemplary embodiment of the present invention. The PDP 30 comprises the first panel 10 and the second panel 20, and the first panel 10 comprises the sustain electrode $12_X$ and the scan electrode $12_Y$ having facing discharge surfaces. Similar to the first exemplary embodiment, a thickness $t_y$ of the scan electrode $12_Y$ may be greater than the thickness $t_x$ of the sustain electrode $12_X$. In this manner, an address voltage may be reduced by disposing the scan electrode $12_Y$ closer to the address electrode 22, and the miss-addressing between the sustain electrode $12_X$ and the address electrode 22 may also be prevented.

In the third exemplary embodiment, equally thick discharge surfaces at the sustain electrode $12_X$ and the scan electrode $12_Y$ may be achieved by forming the first dielectric layer 13 that covers the sustain electrode $12_X$ thicker than the dielectric layer covering the scan electrode $12_Y$.

In a PDP according to exemplary embodiments of the present invention, disposing the sustain electrode and the scan electrode facing each other may provide a linear shaped discharge path. This configuration may decrease a loss of the meta-stable particles due to collisions with the barrier ribs or the fluorescent layers. Therefore, the discharge firing voltage and discharge sustain voltage may be reduced, brightness may be improved, and a high definition PDP may be provided.

The PDP according to exemplary embodiments of the present invention employs improved configurations capable of facilitating an address discharge, thereby reducing a required address voltage and increasing driving efficiency. Disposing the scan electrode close to the address electrode, or forming the scan electrode with a wide discharge surface, may reduce the address voltage.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A plasma display panel (PDP), comprising:

a first panel having a plurality of discharge sustaining electrode pairs; and a second panel having a plurality of address electrodes and facing the first panel, wherein a discharge sustaining electrode pair is arranged in a discharge cell and comprises a scan electrode and a sustain electrode;

wherein a discharge surface of the scan electrode and a discharge surface of the sustain electrode face each other across a discharge space in the discharge cell, the discharge space comprising a gap between the first panel and the second panel; and wherein a distance between the scan electrode and an address electrode is less than a distance between the sustain electrode and the address electrode.

2. The PDP of claim 1, wherein the scan electrode is thicker than the sustain electrode.

3. The PDP of claim 2, wherein the scan electrode and the sustain electrode each comprise a single transparent electrode.

4. The PDP of claim 1, wherein discharging in opposite directions occurs between the scan electrode and the sustain electrode.

5. The PDP of claim 1, wherein the scan electrode and the sustain electrode are formed of a transparent conductive material.

6. The PDP of claim 1, further comprising:

a dielectric layer that covers the scan electrode and the sustain electrode; and a protective layer that covers the dielectric layer.

7. The PDP of claim 6, wherein the discharge space is formed between the protective layer covering the scan electrode and the protective layer covering the sustain electrode.

8. The PDP of claim 6, wherein the protective layer covering the scan electrode is closer to the address electrode than the protective layer covering the sustain electrode.

9. The PDP of claim 6, wherein the protective layer covering the scan electrode and the protective layer covering the sustain electrode are at substantially a same distance from the address electrode.

10. The PDP of claim 9, wherein the dielectric layer covering the sustain electrode is thicker than the dielectric layer covering the scan electrode.

* * * * *